US007218742B2

(12) United States Patent
Kay et al.

(10) Patent No.: US 7,218,742 B2
(45) Date of Patent: May 15, 2007

(54) CONDENSER MICROPHONE ASSEMBLY

(75) Inventors: Kelly Q. Kay, Chicago, IL (US); Mark W. Gilbert, Park Ridge, IL (US)

(73) Assignee: Shure Incorporated, Evanston, IL (US)

( * ) Notice: Subject to any disclaimer, the term of this patent is extended or adjusted under 35 U.S.C. 154(b) by 479 days.

(21) Appl. No.: 10/818,388

(22) Filed: Apr. 5, 2004

(65) Prior Publication Data

US 2004/0184633 A1 Sep. 23, 2004

Related U.S. Application Data

(63) Continuation of application No. 09/745,179, filed on Dec. 20, 2000, now Pat. No. 6,741,709.

(51) Int. Cl.
*H04R 25/00* (2006.01)

(52) U.S. Cl. ..... 381/175; 381/174; 381/191

(58) Field of Classification Search ..... 381/173–175, 381/191, 431; 367/172, 174, 181, 188
See application file for complete search history.

(56) References Cited

U.S. PATENT DOCUMENTS

| | | | |
|---|---|---|---|
| 4,910,840 | A | 3/1990 | Sprenkels |
| 4,993,072 | A | 2/1991 | Murphy |
| 5,146,435 | A | 9/1992 | Bernstein |
| 5,208,789 | A | 5/1993 | Ling |
| 5,316,619 | A | 5/1994 | Mastrangelo |
| 5,490,220 | A | 2/1996 | Loeppert |
| 5,573,679 | A | 11/1996 | Mitchell |
| 5,596,222 | A | 1/1997 | Bernstein |
| 5,740,261 | A | 4/1998 | Loeppert |

(Continued)

FOREIGN PATENT DOCUMENTS

| | | |
|---|---|---|
| WO | WO 97/01258 | 1/1997 |

(Continued)

OTHER PUBLICATIONS

S. Bouwstra et al., "*Silicon Microphones-A Danish Perspective*", Journal of Micromechanics and Microengineering Structures, Devices and Systems, vol. 8, 1998 pp. 64-68.

(Continued)

*Primary Examiner*—Suhan Ni
(74) *Attorney, Agent, or Firm*—Banner & Witcoff, Ltd.

(57) ABSTRACT

A microphone assembly comprising a housing, the housing including an upper lip, a silicon backplate having a top portion, a bottom portion, an annular side portion, a silicon spacer integrally formed with the backplate and comprising at least one protrusion extending from and integral to the top portion of the silicon backplate, the spacer further comprising an insulating layer, such as silicon dioxide or a fluoropolymer. A plurality of openings extend from the top portion of the backplate to the bottom portion of the backplate. A single diaphragm, comprised of metallized polymer film, acts as both a protective environmental barrier and a sensing electrode of a capacitive electroacoustic sensing transducer. A metal ring is positioned against the upper lip of the metal housing. The diaphragm is adhesively affixed to the ring, and the ring, in cooperation with the upper lip and a spring, secure the diaphragm against the insulating layer of the spacer.

14 Claims, 2 Drawing Sheets

U.S. PATENT DOCUMENTS

| | | | |
|---|---|---|---|
| 5,745,438 | A | 4/1998 | Hill |
| 5,753,819 | A | 5/1998 | Rozgo |
| 5,854,846 | A | 12/1998 | Beavers |
| 5,870,482 | A | 2/1999 | Loeppert |
| 5,888,845 | A | 3/1999 | Bashir et al. |
| 5,889,872 | A | 3/1999 | Sooriakumar |
| 6,012,335 | A | 1/2000 | Bashir |
| 6,075,867 | A | 6/2000 | Bay |
| 6,088,463 | A | 7/2000 | Rombach |
| 6,097,821 | A | 8/2000 | Yokoyama |
| 6,243,474 | B1 | 6/2001 | Tai |

FOREIGN PATENT DOCUMENTS

| | | |
|---|---|---|
| WO | WO 98/13934 | 4/1998 |
| WO | WO 00/09440 | 2/2000 |
| WO | WO 00/12427 | 3/2000 |
| WO | WO 00/62580 | 10/2000 |

OTHER PUBLICATIONS

A. Dehe' et al., "*Silicon Micromachined Microphone Chip at Siemens*", Collected Papers: 137th Meeting of the Acoustical Society of America and the 2nd Convention of the European Acoustics Association, 1999.

M. Fischer et al., "*Silicon Microphones: An Overview*", Collected Papers: 137th Meeting of the Acoustical Society of America and the 2nd Convention of the European Acoustics Association, 1999.

P. C. Hsu et al., " *A High Sensitivity Polysilicon Diaphragm Condenser Microphone*", Digest Workshop on MEMS, Jan. 1998, pp. 580-585.

A. E. Kabir et al., "*High Sensitivity Acoustic Transducers with Thin p + Membranes and Gold Back-Plate*", Sensors and Actuators A, vol. 78, 1999, pp. 138-142.

J. Wilkinson, "*Packaging and Interconnect Innovation in Microsystems*", Proceedings 13 th International Conference on Microelectornics and Micropackaging, Aug. 1998, pp. 138-143.

Pirmin Rombach et al., "*A Low-Voltage Silicon Condenser Microphone for Hearing Instrument Applications*", Collected Papers: 137th Meeting of the Acoustical Society of America and the 2nd Convention of the European Acoustics Association, 1999.

David Schafer et al., "*Micromachined Condenser Microphone for Hearing Aid Use*", Solid-State Sensor and Actuator Workshop, Jun. 1998, pp. 27-30.

Altti Torkkeli, et al., "*Capacitive Microphone with Low-Stress Polysilicon Membrane and High-Stress Polysilicon Backplate*", Eurosensors XIII, The Hague, Netherlands, Sep. 1999, pp. 57-60.

R. Mehalso et al., "*MEMS Packaging/Interconnects Challenges and Opportunities*", Proceedings InterPACK '97: Advances in Electronic Packaging, vol. 1, 1997, pp. 463-466.

Gerhard M. Sessler, "*Silicon Microphones*", Journal of the Audio Engineering Society, vol. 44, No. ½, 1996, pp. 16-22.

Mark Sheplak et al., "*A Wafer-Bonded, Silicon-Nitride Membrane Microphone With Dielectrically-Isolated, Singe-Crystal Silicon Piezoresistors*", Solid-State Sensor and Actuator Workshop, Jun. 1998, pp. 23-26.

Xing Yang et al., "*Strength of Surface Micromachined Diaphragms*", Materials Research Society Symposium Proceedings, vol. 518, 1998, pp. 93-97.

Quanbo Zou et al., "*Silicon Capacitive Microphones with Corrugated Diaphragms*", Collected Papers: 137th Meeting of the Acoustical Society of America and the 2nd Convention of the European Acoustics Association, 1999.

FIG.3
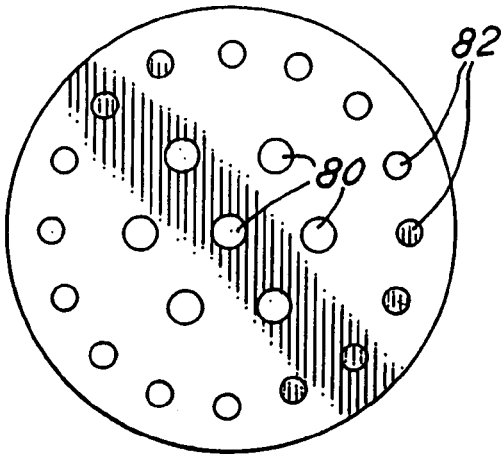
FIG.4
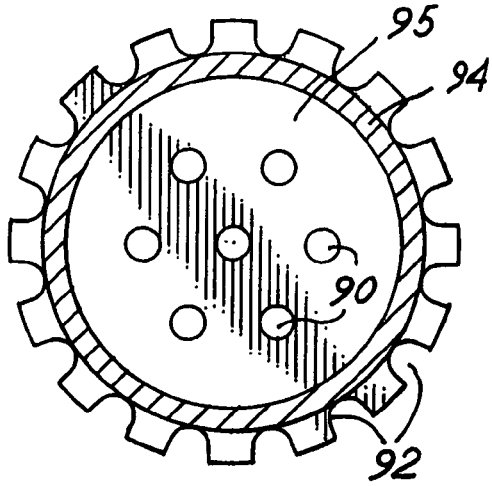
FIG.5
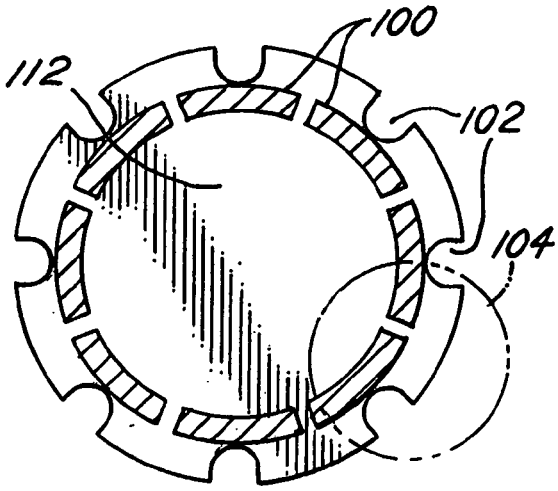
FIG.6
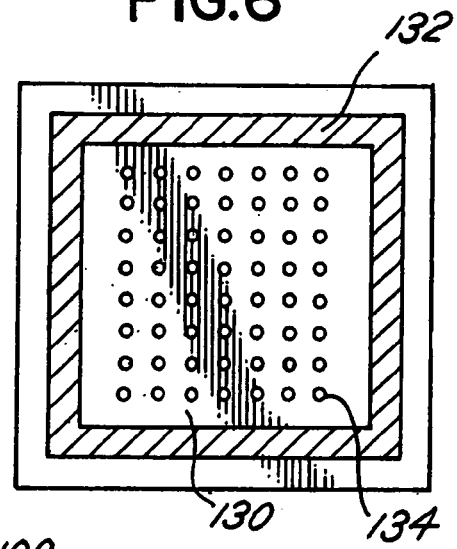
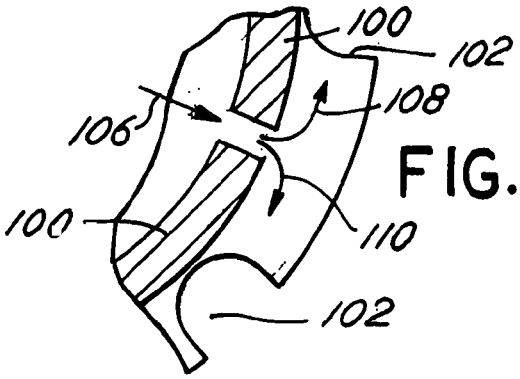
FIG.5A

CONDENSER MICROPHONE ASSEMBLY

This application is a continuation of common-owned, U.S. application Ser. No. 09/745,179 ("Condenser Microphone Assembly") filed on Dec. 20, 2000 now U.S. Pat. No. 6,741,709, naming Kelly Q. Kay and Mark W. Gilbert as inventors, the entire disclosure of which is hereby incorporated by reference.

FIELD OF THE INVENTION

The present invention relates to microphones, and more particularly to condenser microphone assemblies, such as a backplate with integral spacer made From semiconductor components.

BACKGROUND OF THE INVENTION

Condenser or capacitance microphones are widely used in the audio, electronics and instrumentation industries. Condenser microphones include a flexible diaphragm or membrane and a rigid backplate that may contain one or more openings. Sound waves cause the diaphragm to move, resulting in a pressure variation between the membrane and the backplate. This pressure variation results in a difference in the charge between the diaphragm, and the difference in charge is converted to an electrical signal that corresponds to the sound wave. As is known in the art, conventional diaphragms may be constructed From metal films or metallized polymer films.

For a variety of applications, it is desirable to manufacture small, high quality condenser microphones. As is known in the art, openings in the backplate may be created by drilling or punching holes. Controlling the precise size and location of such holes, which can be critical, becomes more difficult as the holes become smaller.

As is also known in the art, entire condenser microphones, including diaphragms, can be formed on silicon substrates through MicroElectroMechanical Systems (MEMS) fabrication methods, which is the formation of mechanical components based on silicon integrated circuit manufacturing processes. For example, U.S. Pat. No. 5,889,872 discloses a capacitive microphone formed with semiconductor processing techniques. A diaphragm is formed as part of the fabrication by applying a polysilicon layer on a silicon nitride layer. The polysilicon layer is patterned or etched to form a diaphragm.

U.S. Pat. No. 5,870,482 explains challenges associated with maintaining highly compliant and precisely positioned diaphragms fabricated from a silicon wafer. That patent discloses an alternative solid state condenser microphone with a semiconductor support structure.

U.S. Pat. No. 6,075,867 discloses a micromechanical microphone with multiple diaphragms. To address problems of humidity, dust and dirt, the microphone includes two sealing membranes on either side of a transducer. However, an environmental membrane in front of a sensing transducer may affect audio characteristics, such as signal to noise ratio, frequency response, and sensitivity.

The formation of complete condenser microphones through MEMS processing is extremely difficult and expensive. Moreover, condenser microphones constructed entirely from MEMS processing often exhibit inferior audio and reliability characteristics.

SUMMARY OF THE INVENTION

The present invention solves many of the aforementioned problems by a microphone assembly comprising a housing, a semiconductor backplate mounted in the housing and a flexible diaphragm located above the backplate. The semiconductor spacer is integrally formed with the backplate and intermediate the backplate and the diaphragm. The backplate and spacer is not integrally formed with the diaphragm, the diaphragm frame, or the housing.

The diaphragm is stretched over and adhesively affixed to the diaphragm frame. The diaphragm frame maintains tension in the diaphragm. The diaphragm is comprised of a metal film or metallized polymer film, and the diaphragm is both a protective environmental barrier and a sensing electrode of a capacitive electroacoustic transducer. The housing may be made of metal, and the backplate made of silicon. The spacer may further comprise an electrically insulating layer, such as silicon dioxide or a fluoropolymer.

The backplate includes a top portion, a bottom portion, and a side portion and a plurality of openings extending from the top portion of the backplate to the bottom portion of the backplate. In one embodiment, the plurality of openings are located along the side portion of the backplate and are radially outward of the spacer. The backplate may be circular, rectangular or another desirable shape. The spacer may consist of an annular wall, a series of arcuate walls, a series of arcuate extensions or a rectangular wall.

The housing comprises an upper lip, and the diaphragm frame comprises a metal ring positioned against the upper lip. The assembly may further comprise a metal contact on the bottom portion of the backplate. Furthermore, the invention may include a spring positioned between the backplate and a lower portion of the housing.

In addition, the invention may comprise a transistor coupled to the housing or the backplate. The microphone assembly may also comprise an application specific integrated circuit (ASIC) coupled to the backplate, and the ASIC may include a transistor.

These as well as other novel advantages, details, embodiments, features and objects of the present invention will be apparent to those skilled in the art from following the detailed description of the invention, the attached claims and accompanying drawings, listed herein, which are useful in explaining the invention.

BRIEF DESCRIPTION OF THE DRAWINGS

In the following text and drawings, wherein similar reference numerals denote similar elements throughout the several views thereof, the present invention is explained with reference to illustrative embodiments, in which:

FIG. 3 is a plan view of a first embodiment of a backplate made in accordance with the present invention;

FIG. 4 is a plan view of a second embodiment of a backplate made in accordance with the present invention;

FIG. 5 is a plan view of a third embodiment of a backplate made in accordance with the present invention;

FIG. 5A is an enlargement of the area shown by the region 104 in FIG. 5; and FIG. 6 is a plan view of a fourth embodiment of a backplate made in accordance with the present invention.

DETAILED DESCRIPTION OF THE INVENTION

Figure 1:
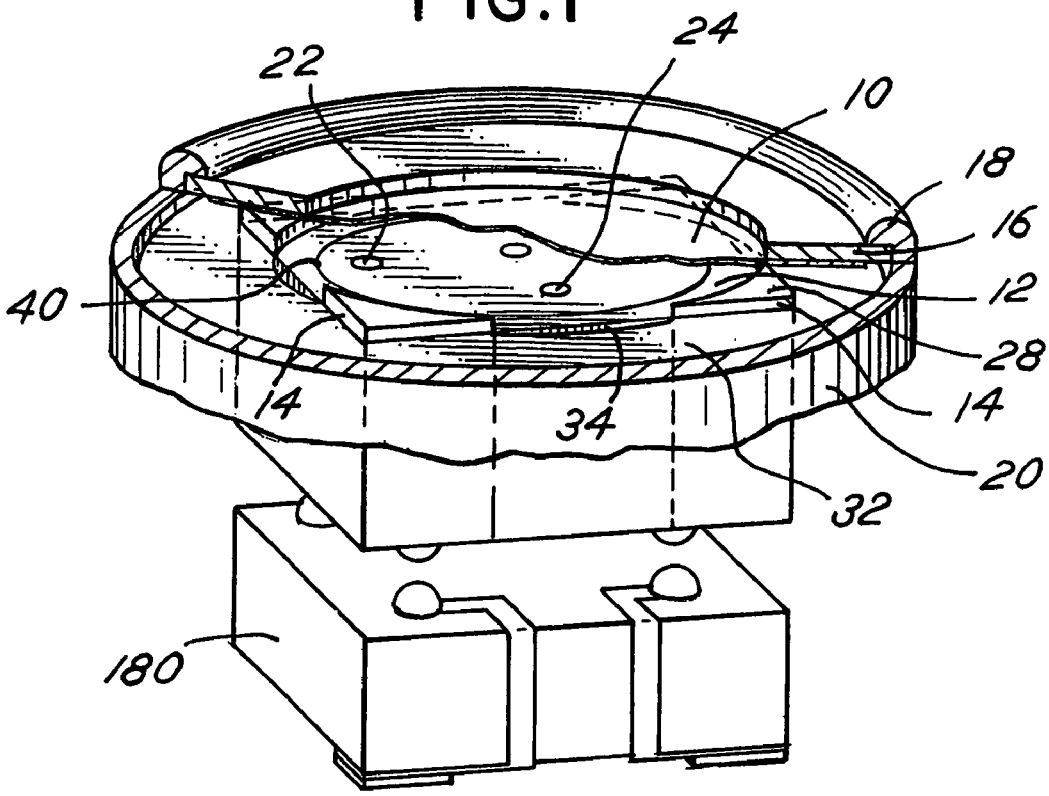
FIG. 1 is a perspective view of a first embodiment of a microphone assembly made in accordance with the present invention.
Figure 2:
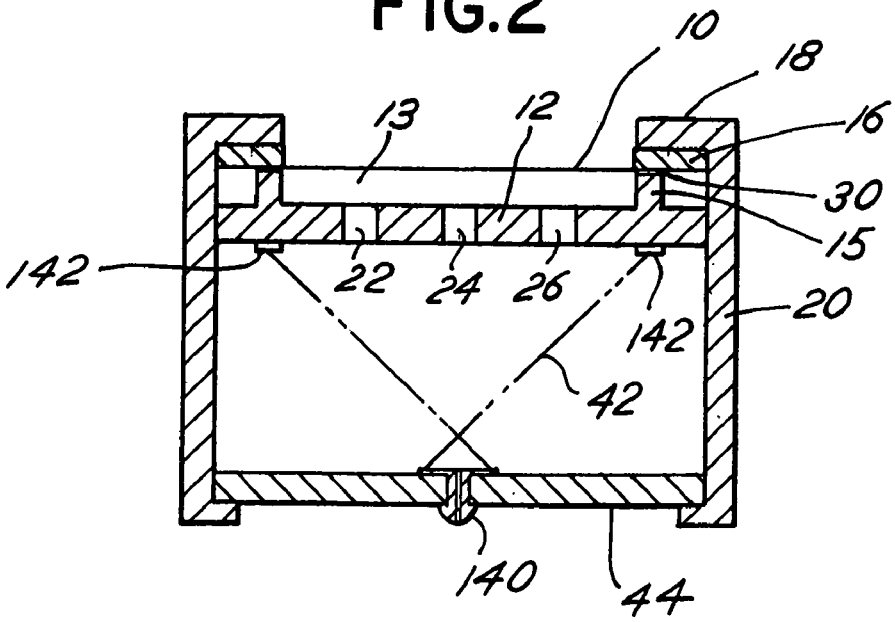
FIG. 2 is a perspective view of a portion of the microphone assembly made in accordance with the present invention

Referring to FIGS. 1 and 2, in a preferred embodiment, the present invention includes a membrane or diaphragm 10 that is separated from a backplate 12. The diaphragm 10 is flexible and is exposed to the air. A protective grille (not shown) may be mounted above the diaphragm 10. The diaphragm 10 is made of a known material for constructing microphone diaphragms, such as metal film or metallized polymer film.

The backplate 12 is rigid or fixed. Integrally formed with the backplate 12 are spacers, shown for example at 14 in FIG. 1 and 15 in FIG. 2. The diaphragm 10 is separated from the backplate 12 by a narrow air gap 13 (shown only in FIG. 2) defined by the spacers 14, 15. The backplate 12 and spacer 14 are fabricated, for example, from semiconductor material, such as silicon, by batch processing techniques. Referring to FIG. 1, a top region 28 of the spacer 14 includes a layer of electrically insulating material, such as silicon dioxide or a fluoropolymer, such as TEFLON. Similarly, referring to FIG. 2, a top region 30 of the spacer 15 includes a similar insulating layer. The spacer may take the form of many shapes, such as a wall or a ridge.

The membrane 10 and the backplate 12 form a capacitor, also known as a condenser. When a sound wave hits the membrane 10, the membrane moves, (causing a variation in height of the air gap 13 between the membrane 10 and the backplate 12. This gap variation results in a change in the capacitance of the condenser formed by the membrane 10 and the backplate 12. If a fixed or controlled charge Q is maintained on the capacitor, a voltage will be formed across the capacitor that will then vary proportionally to the change in the height of the air gap 13.

The diaphragm 10 is stretched over a diaphragm frame 16 and glued or adhesively affixed to the diaphragm frame 16. The diaphragm frame 16 maintains tension in the diaphragm 16. The diaphragm frame 16 is positioned between the spacer 14 and an upper edge 18 of a housing 20. The housing 20 is a known housing not manufactured from batch processing techniques, and is preferably made of metal, not silicon. The housing 20 serves as an electrical ground.

The backplate 12 may include openings or holes indicated by arrows 22, 24 and 26. These openings allow air to pass from the area above the backplate 12 to the area below the backplate 12.

The backplate 12 shown in FIG. 1 is rectangular or square. The backplate is situated in the housing 20 by a nest 32. An opening 34 between the backplate 12 and the nest 32 also allows air to pass from the area above the backplate 12 to the area below the backplate 12. In one embodiment, materials. such as metal, could be −9 selectively deposited in the circular portion indicated by the numeral 40.

Referring to FIG. 2, a spring 42 is used to mechanically bias the backplate 12 against a bottom portion 44 of the housing 20, which is a PC board. The spring 42 causes the spacer 15 of the backplate 12 to be pushed into the diaphragm 10 and the diaphragm frame or ring 16, which consequently press against the upper edge or lip 18 of the housing 20. In this manner, the diaphragm is coupled to the spacer 15. Thus, together, the spring 42, the diaphragm frame 16, the upper lip 18 of the housing 20, the housing 20 and the PC board 44 cooperate to secure the diaphragm 10 against the insulating layer 30 of the spacer 15. The diaphragm 10 is not integrally formed with the spacer 15.

The microphone assembly preferably employs a single diaphragm 10 that serves as both a protective environmental barrier and a sensing electrode of a capacitive electroacoustic transducer. In contrast, prior art systems of silicon fabricated condenser microphones employ either no protective environmental barrier or more than one diaphragm or membrane, one of which serves as an environmental barrier and one of which does not.

A variety of shapes and configurations may be used for the diaphragm 10 and backplate 12. For example in FIG. 1 the diaphragm frame 16 is round and in the form of an annular ring and the backplate 12 is square. One skilled in the art will −10 appreciate that the diaphragm frame 16 and backplate 12 could include other shapes depending on the shape of the housing 20 and the other components of the invention.

Because the diaphragm 10 is not fabricated or processed as part of the backplate 12, the diaphragm is free from stress associate with fabricating and mounting the backplate 12. In addition, the tension on the diaphragm 10 is independent of the internal stresses in the backplate 12. As is recognized in the art, these uncontrolled internal stresses are a common undesirable consequence of semiconductor fabrication processing. Thus, the diaphragm 10 is free floating relative to stress parallel to the face of the backplate 12 or the face of the diaphragm 10. By mounting the diaphragm 10 on a suitable diaphragm frame 16 that is independent from the backplate 12 and spacer 15, the tensile stress of the diaphragm 10 is free from influences from the packaging and the backplate.

FIGS. 3–6 illustrate alternative embodiments with different arrangements of the spacers and holes on a backplate. As would be appreciated by one of ordinary skill in the art, the location, number and size of holes affects the audio characteristics of the microphone. MEMS will allow improved control of the hole size and placement, which will enhance the ability to control frequency response and sensitivity.

Referring to FIG. 3, holes 80 may be located radially inward of spacers 82. Spacers 82 may be small circular protrusions.

Alternatively, FIG. 4 shows holes 90 and notches 92 along a side of a backplate 95 that allow air to pass from above to below the backplate. FIG. 4 also shows an annular spacer wall 94.

FIG. 5 shows a backplate with no holes radially inward of a series of arcuate spacer portions 100. Instead, air passes from above the backplate to below the backplate via openings 102. Arrows 106, 108 and no in FIG. 5A, which is an enlargement of the area 104 in FIG. 5, depict the flow of air from the top of a backplate 112 to the underside of the backplate 112. FIG. 6 further illustrates a rectangular or square backplate 130 with a square or rectangular spacer wall and grid or holes, one of which is shown by 134. As will be appreciated by one of ordinary skill in the art, the spacers may also be or arcuate portions of a wall sufficient to support the diaphragm 10 and diaphragm frame 16.

Referring again to FIG. 2, the backplate 12 is externally biased at output 140 with a voltage bias. The backplate could be externally biased with direct current (DC) voltage or a radio frequency (RF) bias. In one embodiment, a transistor or FET (not shown) is mounted to the PC board 44 within the area defined by the PC board 44 and the housing 20. The FET could also be located outside the housing 20 or directly on the bottom of the backplate 12. Generally, locating the FET closer to the −12 backplate should improve noise characteristics of the invention. The unit could also be biased by an electret, for example, a charged or polarized layer on the backplate 12 (not shown).

The underside of the backplate 12 may include contact regions 142, which are preferably metal, that can be deposited by chemical vapor deposition (CVD) techniques. The spring 42 may provide an electrical contact from the contact region 142 to the region 140.

Referring again to FIG. 1, an integrated circuit (IC) or application specific integrated circuit (ASIC) 180 could be mounted beneath the PC board (not shown). The ASIC could contain a transistor, such as a FET. The ASIC could also include a preamplifier to increase the electrical output of the microphone and/or modify the response of the microphone.

The ASIC could also include an analog to digital converter (AID). The purpose of the AID is to convert the analog output of the microphone, or microphone preamplifier, to a digital signal that can either be used as a direct digital output from the microphone, or a feed to digital signal processing (DSP) circuitry. The purpose of the DSP is to modify the output of the microphone after an AID. The output can either be a digital or analog or both. Specific applications can include equalization, signal compression, frequency dependent signal compression, and self-calibration.

A voltage step up circuit could also be used to allow a readily available compact battery source (e.g. a 9 v battery) to provide an elevated voltage (e.g. 200 v) for externally DC biasing a condenser.

Another embodiment of the invention would include a radio frequency (RF) biasing circuit to provide a bias voltage that oscillates with an RF wavelength. A further purpose for such a circuit is to allow the microphone to output a RF modulated signal for wireless transmission.

Thus, different backplates and different ASIC circuits that could be combined in the housing 20 would permit a variety of potential operations and functions of the microphone.

In the foregoing specification, the present invention has been described with reference to specific exemplary embodiments thereof. Although the invention has been described in terms of a preferred embodiment, those skilled in the art will recognize that various modifications, embodiments or variations of the invention can be practiced within the spirit and scope of the invention as set forth in the appended claims. The specification and drawings are, therefore, to be regarded in an illustrated rather than restrictive sense. Accordingly, it is not intended that the invention be limited except as may be necessary in view of the appended claims.

The invention claimed is:

1. A microphone assembly comprising:

a housing;

a semiconductor backplate mounted in the housing;

a flexible diaphragm located above the backplate, the flexible diaphragm acting as both a protective environmental barrier and a sensing electrode of a capacitive electroacoustic sensing transducer;

a semiconductor spacer integral to the backplate and intermediate the backplate and the diaphragm; and a diaphragm frame, the diaphragm stretched over and adhesively affixed to the diaphragm frame, the diaphragm frame maintaining tension in the diaphragm, the diaphragm frame being independent from the semiconductor backplate and the semiconductor spacer.

2. A microphone assembly as in claim 1 wherein the diaphragm is comprised of a material consisting of the group metal film or metallized polymer.

3. A microphone assembly as in claim 2 wherein the housing is metal.

4. A microphone assembly as in claim 3 wherein the backplate is silicon.

5. A microphone assembly as in claim 4 wherein the spacer further comprises an insulating layer from the group consisting of silicon dioxide or a fluoropolymer.

6. A microphone assembly as in claim 5 wherein the backplate includes a top portion, a bottom portion, and a side portion and a plurality of openings extending from the top portion of the backplate to the bottom portion of the backplate.

7. A microphone assembly as in claim 1 further comprising an integrated circuit coupled to the backplate, the integrated circuit having a transistor.

8. A microphone assembly as in claim 1 further comprising an integrated circuit coupled to the backplate, the integrated circuit having a voltage step up circuit.

9. A microphone assembly as in claim 1 further comprising an integrated circuit coupled to the backplate, the integrated circuit having an RF biasing circuit.

10. A microphone assembly as in claim 9 wherein the RF biasing circuit generates an RF modulated output and the RF modulated output is used for RF wireless transmission.

11. A microphone assembly as in claim 1 further comprising an integrated circuit coupled to the backplate, the integrated circuit having a digital signal processor.

12. A microphone assembly as in claim 1 further comprising an integrated circuit coupled to the backplate, the integrated circuit having an analog to digital converter.

13. A microphone assembly as in claim 1 wherein the housing includes an upper edge and the upper edge presses the diaphragm frame and the diaphragm into the spacer.

14. A microphone assembly comprising:

a housing;

a semiconductor backplate mounted in the housing;

a semiconductor spacer comprising a protrusion extending from and integral to the backplate;

a single diaphragm comprised of the group consisting of a metal film or a metallized polymer film, the single diaphragm acting as both a protective environmental barrier and a sensing electrode of a capacitate electroacoustic sensing transducer; and a diaphragm frame, the diaphragm stretched over and adhered to the frame, the diaphragm frame being independent from the semiconductor backplate and the semiconductor spacer.

* * * * *